US005348418A

United States Patent [19]

Campbell

[11] Patent Number: 5,348,418

[45] Date of Patent: Sep. 20, 1994

[54] ASPHALT FINISHING SCREED HAVING ROTARY COMPACTOR

[75] Inventor: Thomas R. Campbell, Chattanooga, Tenn.

[73] Assignee: Astec Industries, Inc., Chattanooga, Tenn.

[21] Appl. No.: 878,732

[22] Filed: May 5, 1992

[51] Int. Cl.[5] ..... E01C 19/48; E01C 19/26

[52] U.S. Cl. ..... 404/103; 404/72; 404/118; 404/122; 404/124

[58] Field of Search ..... 404/102–103, 404/117–118, 122, 124, 128, 101, 108, 113, 81, 92, 110, 115, 72, 126, 121

[56] References Cited

U.S. PATENT DOCUMENTS

| | | | |
|---|---|---|---|
| 1,955,224 | 4/1934 | Brown . | |
| 2,162,665 | 6/1939 | Mosel . | |
| 2,597,221 | 5/1952 | Barber . | |
| 2,754,734 | 7/1956 | Gardner . | |
| 3,262,378 | 7/1966 | Schrimper et al. . | |
| 3,614,916 | 10/1971 | Benson . | |
| 3,699,855 | 10/1972 | Leister | 404/108 |
| 3,825,361 | 7/1974 | Steiner . | |
| 3,907,451 | 9/1975 | Fisher et al. . | |
| 4,260,280 | 4/1981 | Hirn et al. . | |
| 4,493,585 | 1/1985 | Axer . | |
| 4,702,642 | 10/1987 | Musil . | |
| 4,708,519 | 11/1987 | Davin et al. | 404/101 |
| 4,878,544 | 11/1989 | Barnhart . | |
| 5,062,738 | 11/1991 | Owens . | |

FOREIGN PATENT DOCUMENTS

| | | | |
|---|---|---|---|
| 1634425 | 8/1970 | Fed. Rep. of Germany | 404/121 |
| 2422897 | 11/1975 | Fed. Rep. of Germany | 404/122 |
| 2513400 | 10/1976 | Fed. Rep. of Germany | 404/124 |
| 2739338 | 9/1978 | Fed. Rep. of Germany | 404/124 |
| 0996606 | 2/1983 | U.S.S.R. | 404/128 |
| 86/02963 | 5/1986 | World Int. Prop. O. | 404/108 |

*Primary Examiner*—Ramon S. Britts
*Assistant Examiner*—James A. Lisehora
*Attorney, Agent, or Firm*—Nilles & Nilles

[57] ABSTRACT

An asphalt finishing screed is disclosed which is adapted to achieve essentially complete compaction of the asphalt mix over a range of finished mat thicknesses. The screed comprises a vertically adjustable strike off bar, a rotary compactor positioned immediately behind the bar, and a screed plate positioned immediately behind the rotary compactor. In one preferred embodiment, the rotary compactor comprises a rotor which includes a plurality of freely rotating rollers about the peripheral surface thereof. In operation, the adjustable strike off bar is set at an elevation so as to meter the material to the rotary compactor and to achieve the desired compaction for the particular thickness of the finished mat being laid. The rotary compactor then impacts the mat in an essentially vertical direction and so as to achieve complete compaction of the mix.

19 Claims, 9 Drawing Sheets

ASPHALT FINISHING SCREED HAVING ROTARY COMPACTOR

BACKGROUND OF THE INVENTION

The present invention relates to a finishing screed for compacting and smoothing an asphalt mix and which is useful in forming roadway surfaces.

Present asphalt paving machines commonly comprise a self propelled tractor which deposits the asphalt on the ground behind the tractor, and which then distributes the deposited mix transversely by means of a pair of rotating augers which are transversely directed. The tractor mounts a trailing finishing screed by means of a pair of rearwardly extending tow arms which are pivoted to the opposite sides of the tractor, and so that the forward ends of the tow arms may be raised and lowered. The finishing screed is attached between the rear ends of the tow arms so as to follow the tractor in a free floating arrangement. The screed serves to spread and compact the asphalt which has been deposited by the tractor unit. Known screeds typically comprise a strike off bar which is followed by a tamper bar, with the tamper bar being mounted on an eccentric shaft so as to vertically reciprocate upon rotation of the shaft. The tamper bar is in turn followed by a horizontal screed plate, which is usually heated.

A major problem associated with known screeds of the described type is the fact that the tamper bar stroke cannot be adjusted to accommodate different mat thicknesses. For example, asphalt mix typically compacts about ¼ inches per inch of thickness at full compaction, and thus the initial uncompacted thickness should be about 1¼ inches to achieve a 1 inch finished mat. For a 2 inch finished mat, an initial thickness of about 2½ inches is required, and so forth.

The stroke of the tamper bar in most conventional screeds is set to be about 3/16 inch, and longer strokes have not been practical since the bearings are not able to support the forces that would be generated by the rapidly reciprocating bar moving a greater distance. This eccentric stroke determines the maximum compaction that can be obtained, and thus known screeds are not able to fully compact mats having a thickness greater than about 1 inch. To remedy this deficiency, it is usual to provide a number of self propelled rollers which follow the paving machine, and which serve to further compact the asphalt mat. In particular, a breakdown roller, a rubber tired roller, and a sealing or finishing roller are usually provided for this purpose.

It is accordingly an object of the present invention to provide a finishing screed of the described type and which is able to achieve substantially full compaction of an asphalt mat over the full range of usual mat thicknesses, including very thick mats.

It is another object of the present invention to provide a finishing screed of the described type which minimizes the need for the use of self propelled rollers to complete the compaction operation.

It is still another object of the present invention to provide a finishing screed of the described type and which is able to meter a readily selectable thickness of the asphalt material to the compactor of the screed so as to achieve full compaction of the desired final mat thickness.

SUMMARY OF THE INVENTION

The above and other objects and advantages of the present invention are achieved in the embodiments illustrated herein by the provision of a finishing screed which comprises a strike off bar extending transversely across the width of the screed for spreading the mix delivered in front thereof to a predetermined thickness, and rotary compaction means positioned behind the strike off bar and extending transversely across the width of the screed for compacting the mix which has been spread by said strike off bar. The rotary compaction means comprises a rotor mounted for rotation about a transverse axis, and drive means for rotating the rotor about the transverse axis. Also, the screed includes a screed plate positioned behind the rotary compaction means and extending transversely across the width of the screed. The plate has a horizontal bottom surface for engaging and smoothing the compacted mix.

In one preferred embodiment, the peripheral surface of the rotor includes a plurality of transversely extending protrusions which are arcuately curved outwardly when viewed in a direction parallel to the transverse axis, and which are circumferentially spaced apart. These arcuate protrusions may each comprise a roller which is rotatably mounted to the rotor for free rotation about an axis parallel to the transverse axis.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
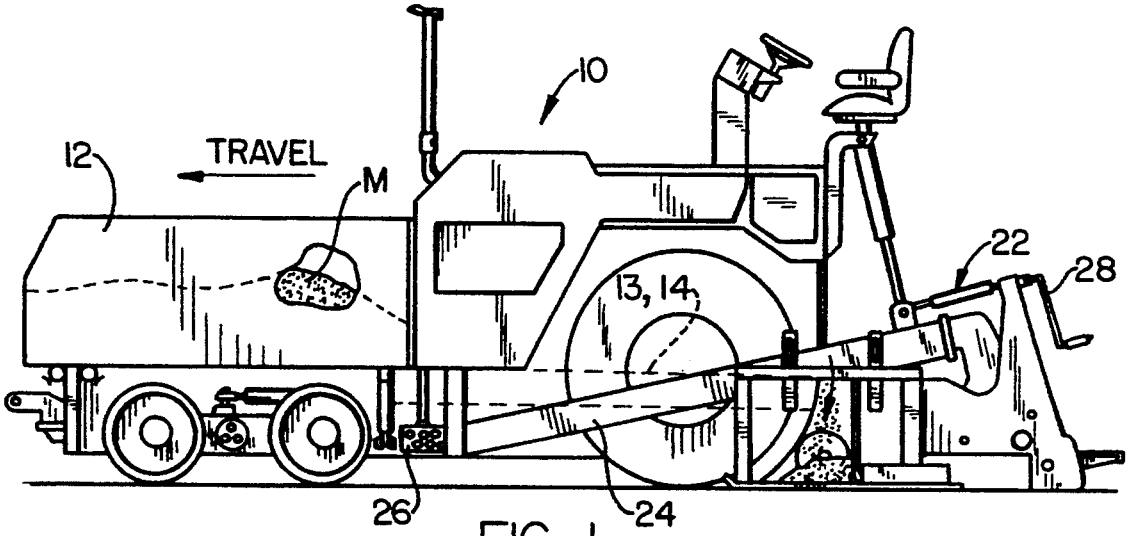
FIG. 1 is a side elevation view of a roadway paving machine which comprises a tractor and an asphalt finishing screed which embodies the present invention mounted at the trailing end of the tractor.
Figure 2:
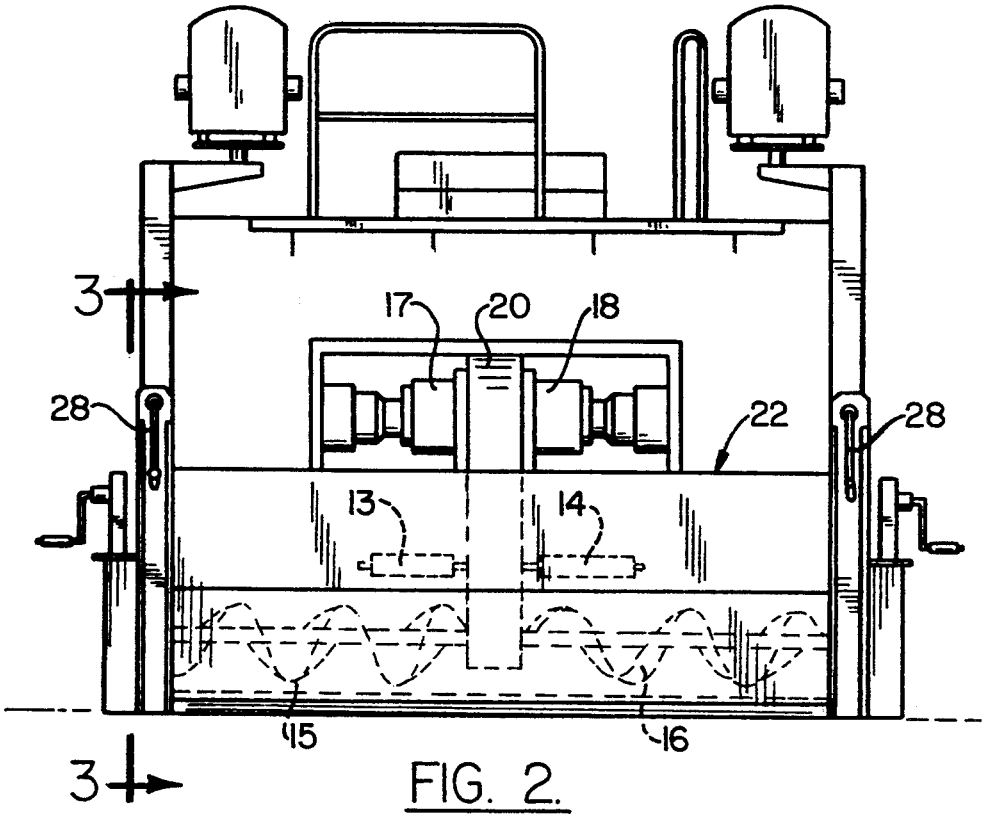
FIG. 2 is a rear elevation view of the paving machine shown in FIG. 1.

Referring more particularly to the drawings, FIGS. 1 and 2 illustrate a roadway paving machine which embodies the present invention, and which includes a self propelled tractor 10 of conventional construction. The tractor 10 includes a hopper 12 at its forward end for receiving the asphalt mix M, and a pair of slat-type conveyors 13, 14 extend from the hopper rearwardly for discharging the mix at the rearward end of the tractor as the tractor moves forwardly. The tractor 10 further includes a pair of transversely directed distribution augers 15, 16 for distributing the deposited mix transversely, note FIGS. 2 and 4 As seen in FIG. 2, the augers 15, 16 are driven by hydraulic motors 17 and 18 respectively, which are mounted at the rear end of the tractor 10 above the augers and which act through drive transmissions which are housed in the casing 20.

A finishing screed which embodies the novel features of the present invention is indicated generally at 22. The screed 22 is mounted to the tractor 10 by means of a pair of tow arms 24, 25 which are pivotally connected to mounting brackets 26 on respective opposite sides of the tractor at the forward ends of the arms. The screed 22 is attached between the rear ends of the tow arms, so that the screed 22 and tow arms 24, 25 are free floating about the axis defined by the pivotal connection of the arms to the brackets 26 of the tractor 10.

As is conventional, the elevation of the brackets 26 on the tractor can be adjusted, by which the angle of attack of the screed 22, and thus the thickness of the asphalt mat being compacted, may be adjusted. More particularly, when the angle of attack is changed, the screed 22 rides up or down in the mix until a new equilibrium position is reached, thereby changing the thickness of the mix which is compacted into the finished mat. In addition, the interconnection between each of the rear ends of the tow arms 24, 25 and the screed includes a hand crank 28 by which the angle of attack may be manually adjusted, again as is conventional.

Figure 3:
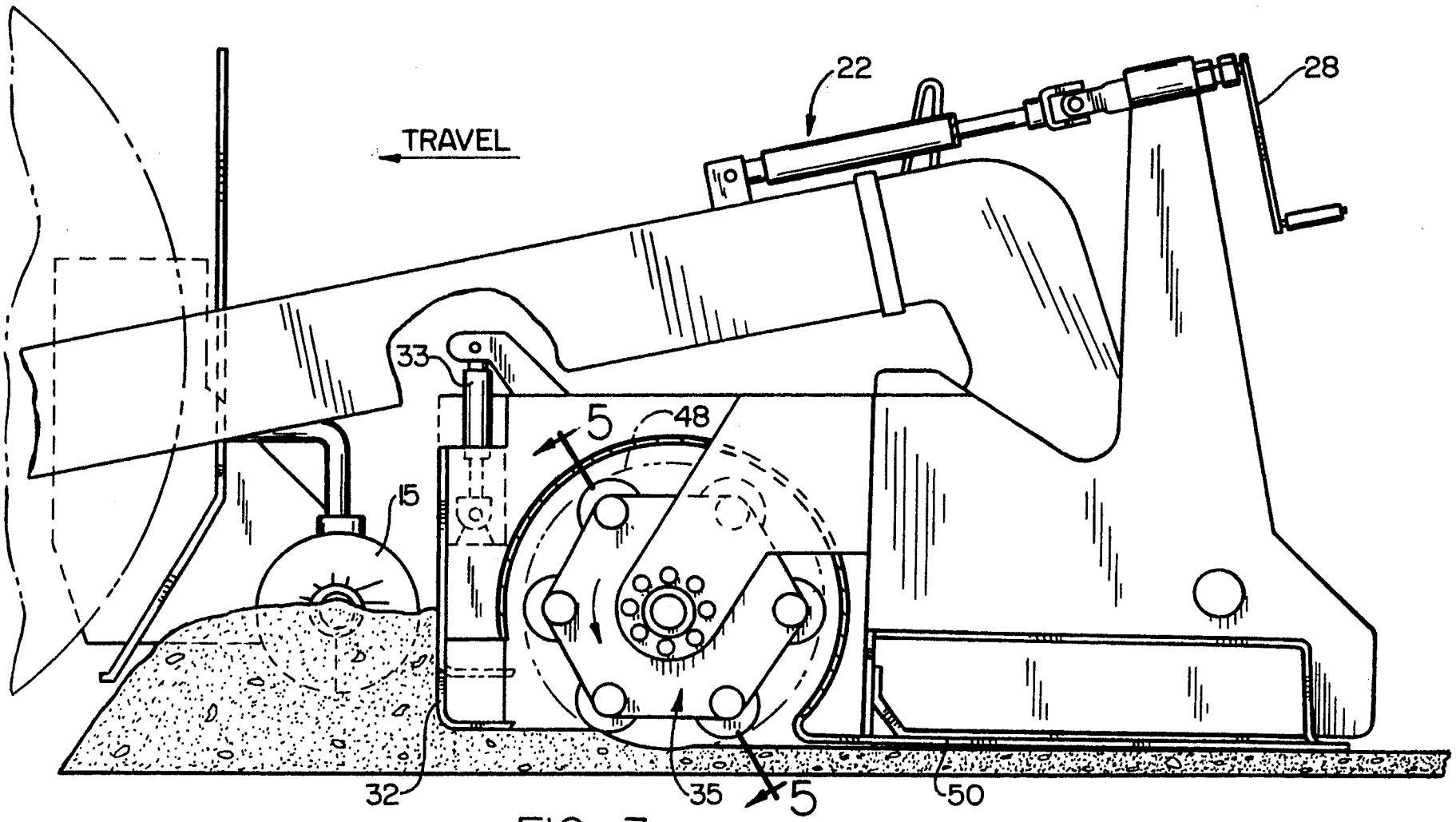
FIG. 3 is a fragmentary side elevation view of the screen shown in FIG. 1, with the side panels removed so as to illustrate the rotary compactor.
Figure 4:
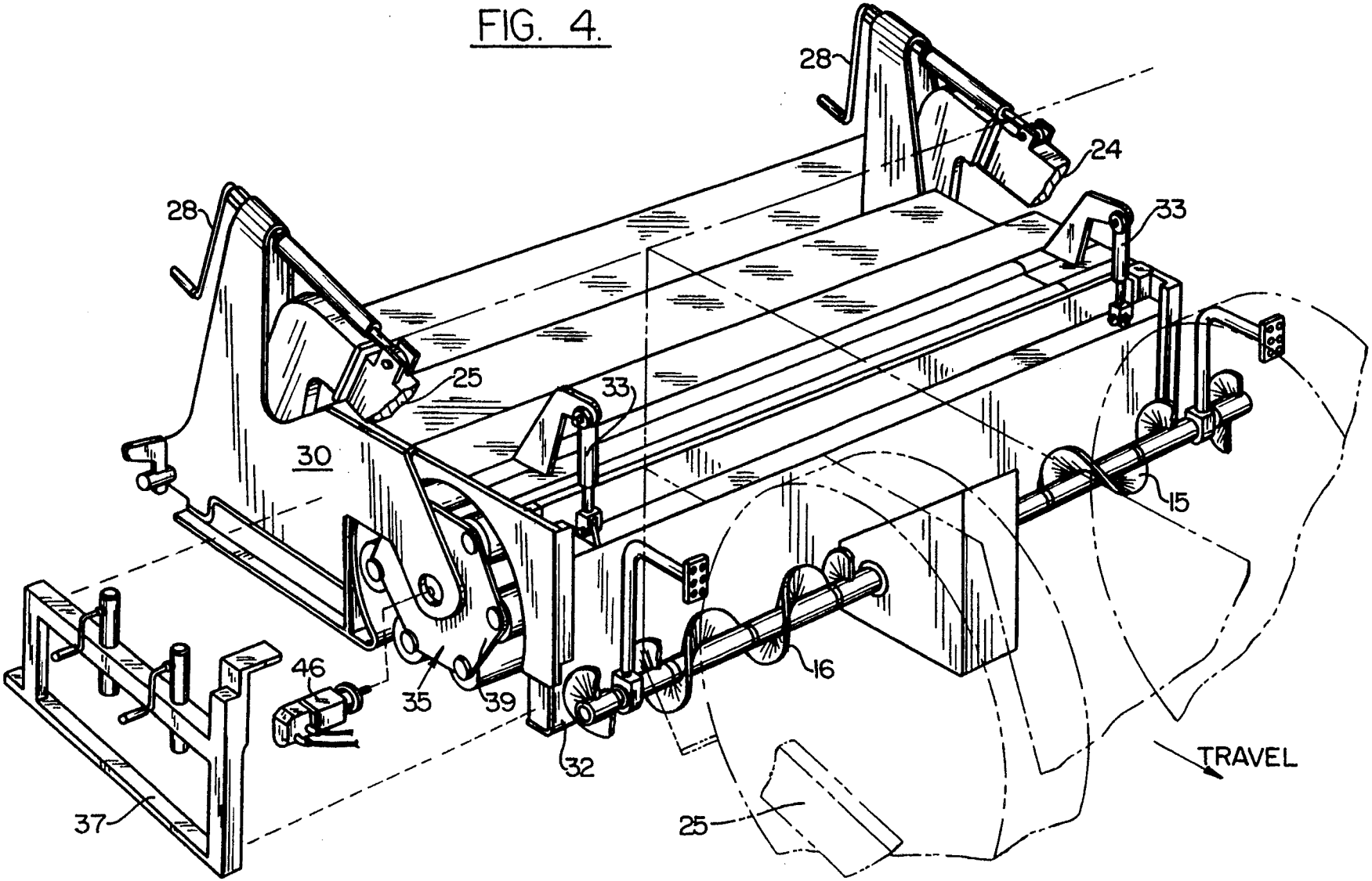
FIG. 4 is a fragmentary and partially exploded perspective view illustrating the augers which are mounted to the trailing end of the paving machine, and the screed of the present invention.

The finishing screed 22 comprises a frame which includes a pair of upright side plates 30 which are typically spaced apart a distance of about 10 feet to define the width of the machine. The frame 30 and the tow arms 24 and 25 form, in combination, a screed support assembly. As best seen in FIGS. 3 and 4, the screed 22 also comprises a transversely directed strike off bar 32 which is mounted to the frame and extends across substantially the full width of the screed. The bar 32 serves to spread the mix which is delivered in front thereof to a predetermined thickness, and it is mounted for vertical adjustment by a pair of hydraulic cylinders 33.

The screed 22 further includes a rotary compactor 35 which is positioned immediately rearwardly of the strike off bar 32 and which extends transversely across substantially the full width of the screed. The rotary compactor 35 comprises a rotor 36 which is rotatably mounted between the pair of side plates 30, and for rotation about a horizontal transverse axis. The lateral sides of the rotor 36 are protectively covered by a side panel (not shown), and which is supported by a suitable frame 37 as best seen in FIG. 4 and so that its elevation may be adjusted.

Figure 5:
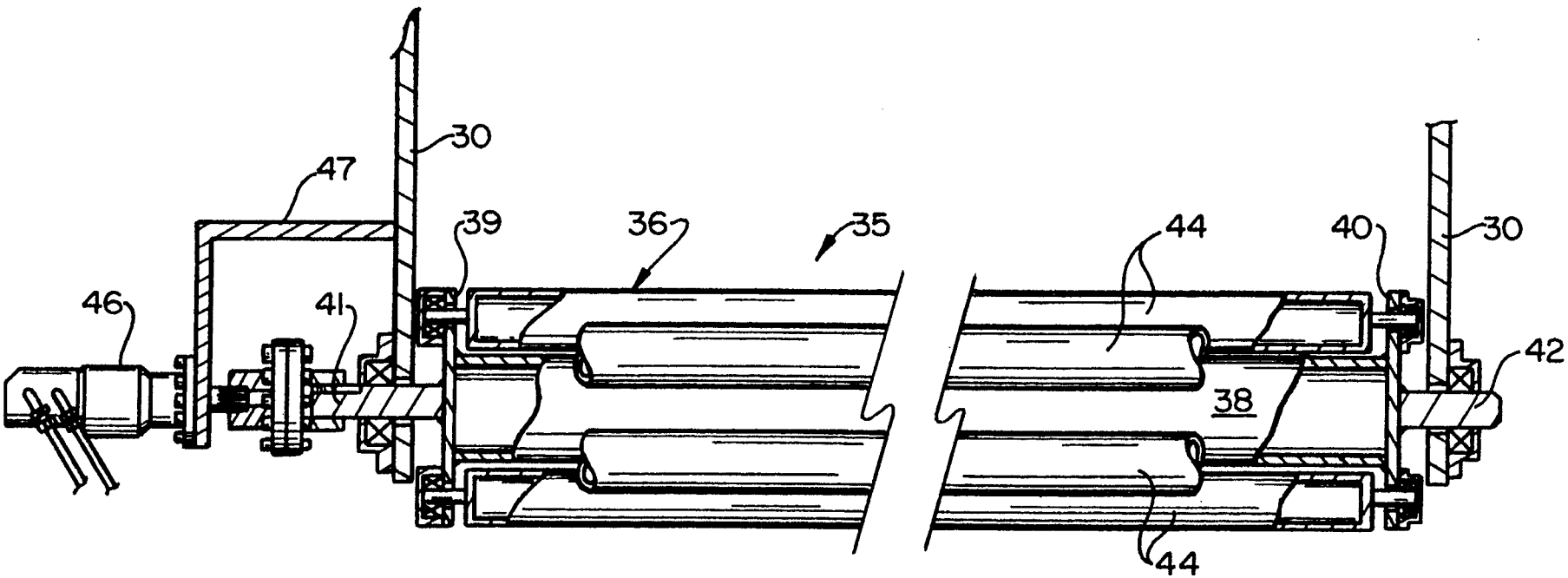
FIG. 5 is a fragmentary and partly sectioned front elevation view of the rotary compactor of the present invention.

In the embodiment of FIGS. 3–5, the rotor includes a central support shaft 38 which extends horizontally between two end plates 39, 40 and the end plates 39, 40 mount coaxial mounting shafts 41, 42 respectively. A total of six rollers 44 are each rotatably mounted between the end plates 39, 40 for free rotation about an axis which is parallel to the transverse rotational axis of the rotor 36. The six rollers 44 are equally spaced about the circumference of the rotor 36, and the rotor is rotatably driven by a hydraulic motor 46, and which is connected to the mounting shaft 41. Also, the motor 46 is rotatably supported on a suitable bracket 47 which in turn is fixed to one of the side plates 30. During rotation of the rotor 36, the outer peripheries of the rollers 44 generate an outer circle 48 (FIG. 3), which typically has a diameter of about two feet, and the direction of its rotation corresponds to the intended forward direction of movement of the tractor and screed. Also, when viewed in a direction parallel to the transverse axis, the rollers 44 define a peripheral surface which is composed of a plurality of traversely extending protrusions which are arcuately curved outwardly, note for example FIG. 3.

As will be apparent, the vertical adjustment of the strike off bar 32 changes its elevation with respect to the generated circle 48 of the rotary compactor 35, and thus the vertical compaction distance of the mix is adjustable. This feature in turn permits the vertical compaction distance to be chosen in accordance with the overall thickness of the mix and so that full compaction can be achieved for all normal thicknesses of the mix, including thicknesses of several inches.

A screed plate 50 is mounted rearwardly of the rotary compactor 35, and the plate 50 extends transversely across the complete width of the screed. Also, the plate 50 has a horizontal planar bottom surface which is adapted to engage and smooth the compacted mix, and as is conventional, the plate may be heated to facilitate the smoothing operation.

In operation, the tractor 10 is advanced forwardly at a predetermined speed, which is typically about 15 feet per minute, and while depositing the asphalt mix from its hopper 12 onto the ground at a discharge location which is immediately in front of the augers 15, 16. The augers then transversely distribute the mix in front of the strike off bar 32 of the screed.

The height of the strike off bar 32 is adjusted with respect to the rotary compactor 35 so that the compactor provides full compaction for the given thickness of the mix. Thus for example, for a 2 inch finished mat, the strike off bar is adjusted to be ½ inch above the lowermost level of the generated circle 48 of the rollers.

The rotary compactor 35 is rotated at a predetermined rotational speed, such as about 75 rpm. By design, the forward speed of the tractor 10 and the rotary speed of the compactor 35 are coordinated so that each roller 44 strikes a segment of the uncompacted mix having a predetermined length in the forward or machine direction. This in turn permits the striking force to be essentially vertical, without a significant force component in either the forward or reverse directions. Also, the fact that the rollers 44 are freely rotatable serves to minimize any force components applied to the mix in the forward or reverse directions.

Figure 6:
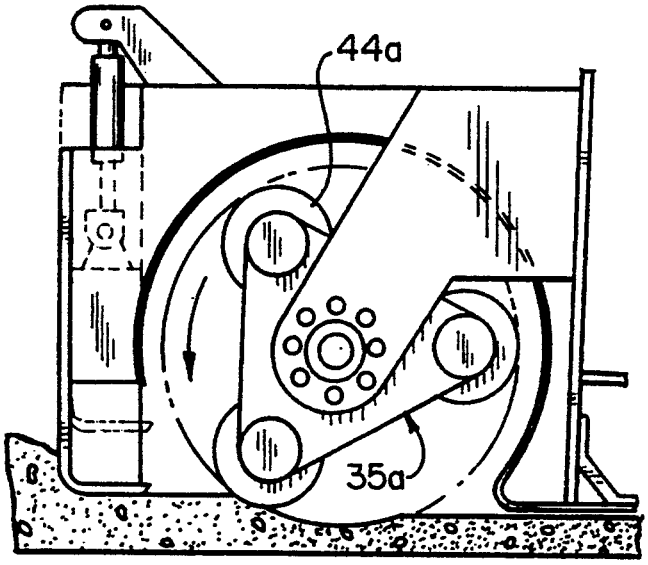
FIGS. 6, 7, 8 and 9 are fragmentary side elevation views each illustrating further embodiments of the rotary compactor of the present invention.

FIG. 6 illustrates an embodiment of the present invention which incorporates only three rollers **44*a* on the rotary compactor 35*a***, but which is otherwise similar to the above described embodiment.

Figure 7:
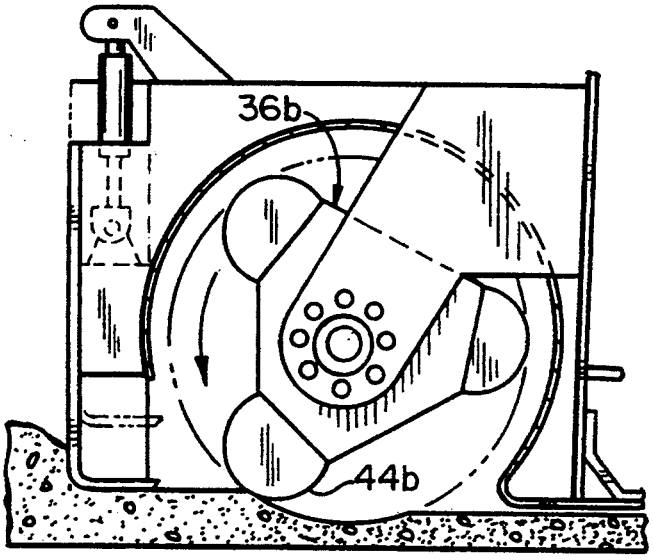

FIG. 7 illustrates an embodiment wherein the outer periphery of the rotor **36*b* is defined by half-rounds 44*b***, which are fixedly mounted between the end plates of the rotor and which are suitable for certain mix compositions.

Figure 8:
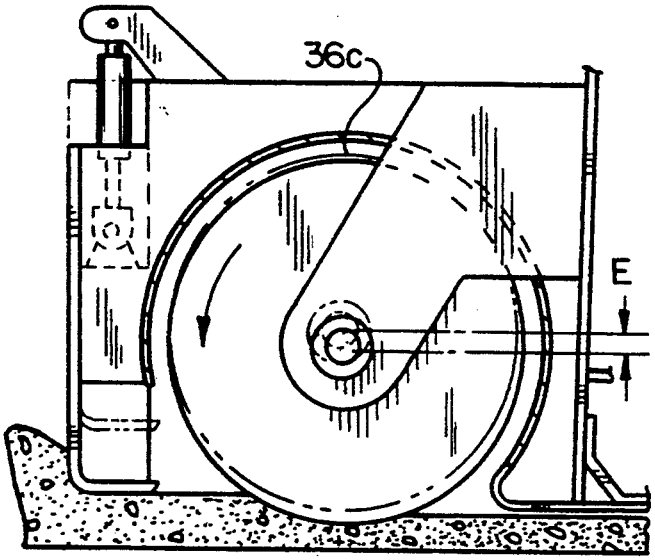

FIG. 8 illustrates an embodiment wherein the rotor **36*c*** comprises a cylindrical roller, which includes eccentrically positioned mounting shafts, and so that the roller is mounted for eccentric rotation about a transverse rotational axis, and such that the roller reciprocates by the vertical eccentric distance E during its rotation. This reciprocation is effective in compacting mixes of certain compositions.

Figure 9:
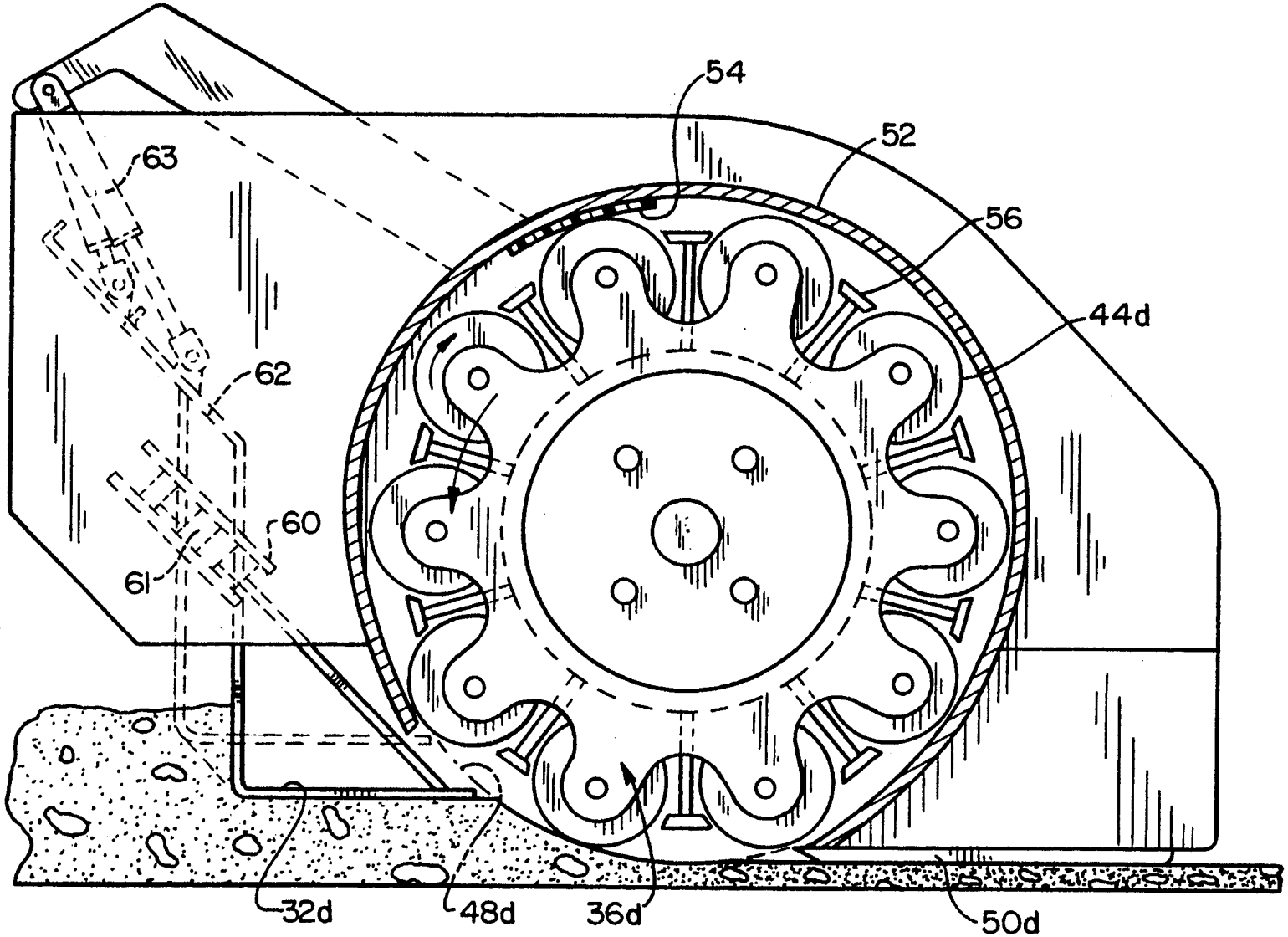
Figure 10:
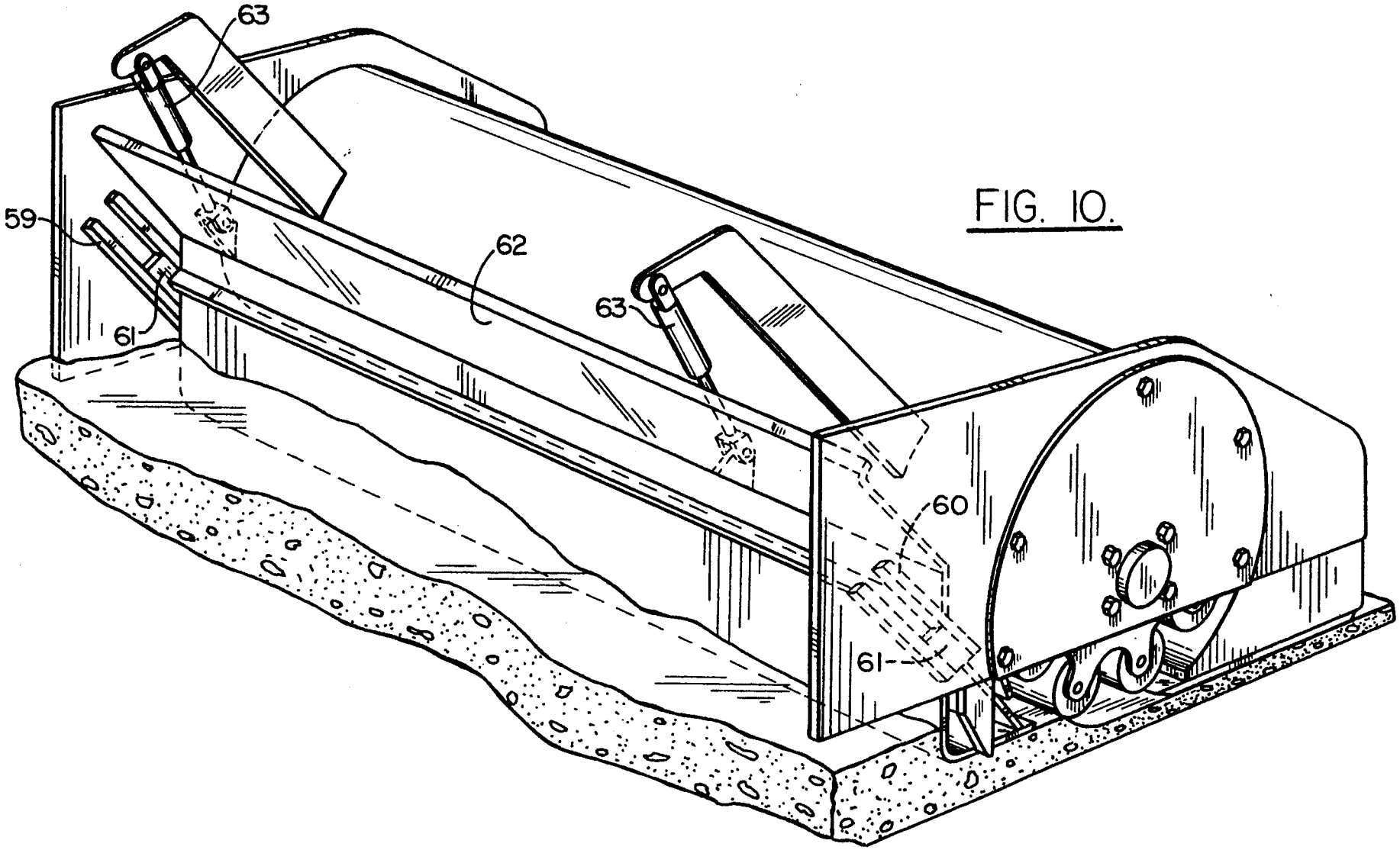
FIG. 10 is a front perspective view of the screed illustrated in FIG. 9.
Figure 11:
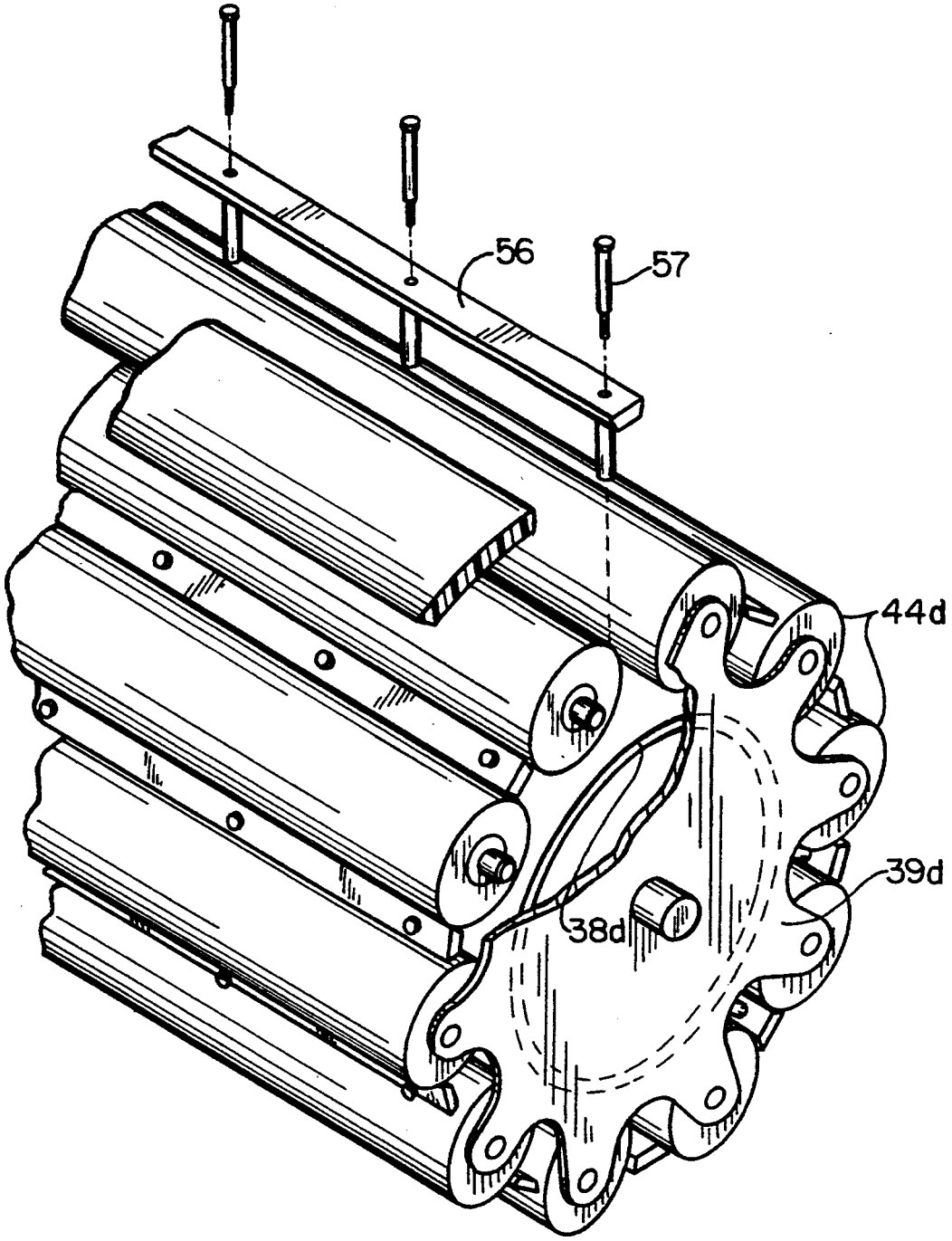
FIG. 11 is a fragmentary and partly exploded perspective view of the rotary compactor of screed illustrated in FIG. 9.

FIGS. 9–11 illustrate a further embodiment of the invention wherein the rotor 36*d* of the rotary compactor comprises a central support shaft 38*d* extending between the end plates 39*d*, and a total of ten freely rotatable rollers 44*d* mounted about the periphery of the shaft 38*d*. A housing plate 52, which is in the form of a segment of a cylinder, closely surrounds the rotor 36*d*, and the inside surface of the housing plate mounts a rubber-like resilient pad 54 which is positioned to engage the outer periphery of each roller 44*d* as the rotor is rotated. This engagement causes the rollers 44*d* to rotate in a direction opposite to the direction of rotation of the rotor, and such that the rollers 44*d* contact the asphalt mat with very little lateral force being imparted to the mat. In other words, the rollers 44*d* impact the mat with an essentially vertical force component, with essentially no force components in the direction of travel of the machine and which would tend to push the mat in either the forward or reverse machine direction.

The embodiment of FIGS. 9–11 also includes a plurality of transversely directed scraper blades 56 mounted to the support shaft 38*d* by radially directed bolts 57, and such that one scraper blade is positioned between each adjacent pair of rollers 44*d*. The scraper blades 56 are positioned so as to remove any of the asphalt mix which adheres to the surface of the rollers 44*d*. Also, in this embodiment, the strike off bar 32*d* extends inwardly to a location which is closely adjacent the generated circle 48*d*, and it is mounted for adjustable upward movement along an angle of about 45°. More particularly, and as best seen in FIG. 10, the mounting arrangement for the strike off bar 32*d* includes a pair of guides 59, 60 mounted to the side plates of the frame, with the guides being mounted at an angle of about 45° from the horizontal. The opposite sides of the strike off bar 32*d* each include a block 61 which is slidably mounted in the associated guide, and the strike off bar 32*d* includes an upper segment 62 which is attached to the outputs of two hydraulic cylinders 63. Thus as best seen in FIG. 9, the cylinders 63 are able to lift the strike off bar 32*d* along a direction which is inclined at about 45°, and between the illustrated solid and dashed line portions.

The forward edge of the screed plate 50*d* also extends to a location closely adjacent the generated circle 48*d*, and such that there is a spacing of, for example, only about 1/16 inch between the forward edge of the screed plate and the generated circle. This close spacing is desirable in that it reduces the amount of the mix which is drawn between the housing plate 52 and the rotor 36*d*. However, in the event some of the mix nonetheless enters between the housing and rotor, the housing plate may be provided with a number of openings (not shown) to permit the mix to exit. Alternatively, the housing plate 52 may be pivotally mounted to the frame of the screed so as to permit it to be lifted to thereby permit the operator to gain access to the rotary compactor for cleaning purposes.

Figure 12:
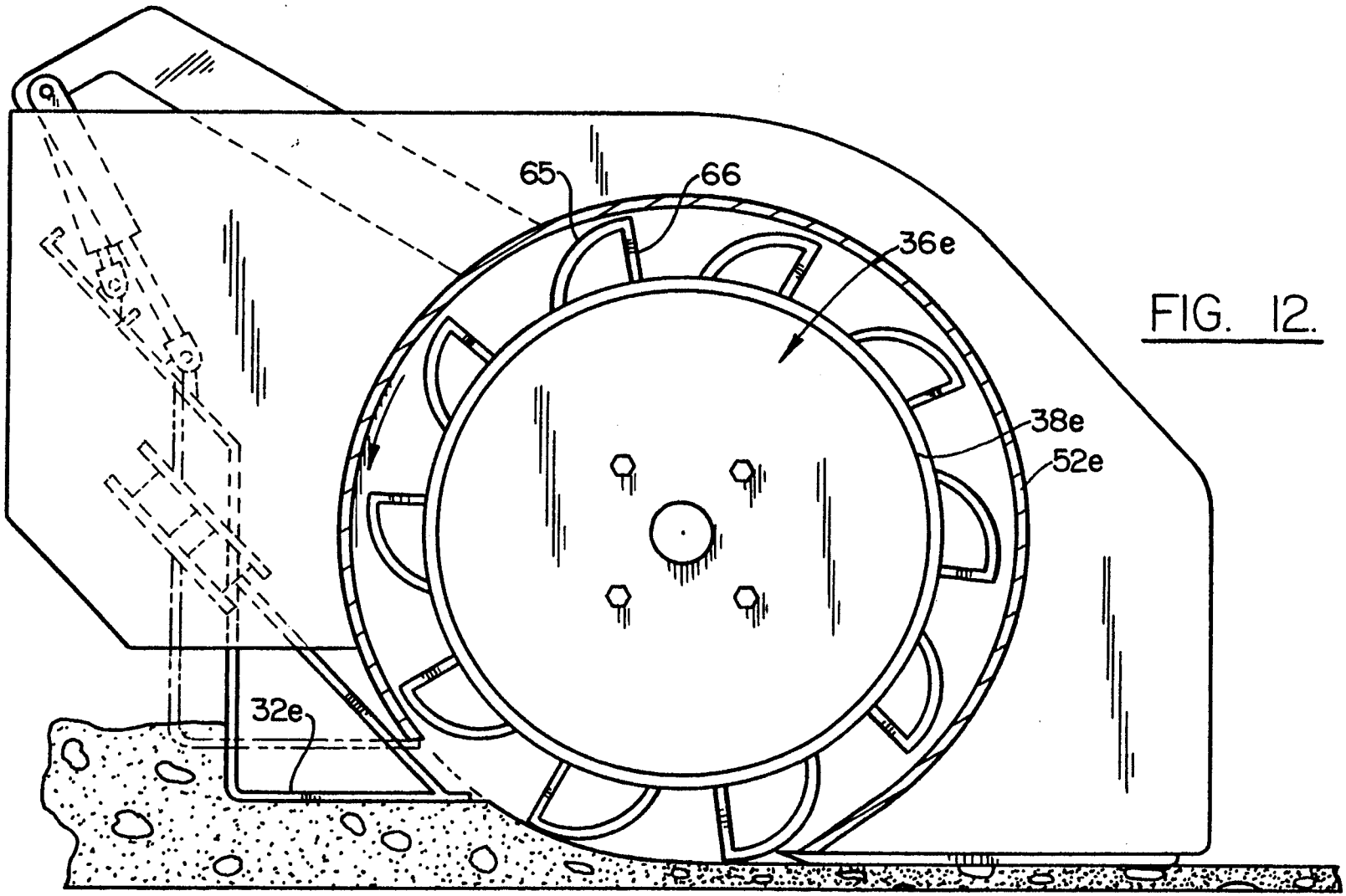
FIG. 12 is a fragmentary side elevation view of still another embodiment of a screed in accordance with the present invention.

FIG. 12 illustrates a further embodiment wherein the rotor 36*e* of the rotary compactor comprises a support shaft 38*e* mounted between end plates and which is in the form of a cylindrical drum. The periphery of the drum mounts a total of ten protrusions, and each protrusion includes a forwardly, facing arcuate plate 65 which curves outwardly from the surface of the drum 38*e*, and a rearward plate 66 which extends radially between the rearward end of the arcuate plate 65 and the drum 38*e*. As the drum rotates, the outer peripheries of the protrusions generate a circle, and act to compact the mat of asphalt.

The embodiment of FIG. 12 includes a housing plate 52*e* and a strike off 32*e* bar substantially as described above with respect to the embodiment of FIGS. 9–11.

In the drawings and specification there has been set forth a preferred embodiment of the invention, and although specific terms are employed, they are used in a generic and descriptive sense only and not for purposes of limitation.

That which is claimed is:

1. A paving machine comprising:

a tractor;

a screed support assembly mounted on said tractor; and an asphalt screed for compacting and smoothing an asphalt mix which is deposited on the ground in front of said screed as said screed is drawn along the ground by said tractor, said asphalt screed including a strike off bar, mounted on said screed support assembly and extending across the width of said screed, for spreading the mix delivered in front thereof to a predetermined thickness, rotary compaction means, mounted on said screed support assembly, positioned behind said strike off bar, and extending transversely across the width of said screed, for compacting the mix which has been spread by said strike off bar, and comprising a rotor mounted for rotation about a transverse axis, and drive means for rotating said rotor about said transverse axis, and a screed plate mounted on said screed support assembly, positioned behind said rotary compaction means, and extending transversely across the width of said screed and having a horizontal bottom surface for engaging the compacted mix, wherein said screed support assembly and said strike off bar, said rotary compaction means, and said screed plate float freely as a unit with respect to said tractor, and wherein said strike off bar is vertically adjustable with respect to said screed support assembly so as to control the thickness of the mix being metered to said rotary compaction means.

2. The paving machine as defined in claim 1 wherein said rotor includes a peripheral surface which is composed of a plurality of transversely extending protrusions which are arcuately curved outwardly when viewed in a direction parallel to said transverse axis and which are circumferentially spaced apart.

3. The paving machine as defined in claim 2 wherein said arcuate protrusions each comprise a roller which is mounted for free rotation about an axis parallel to said transverse axis.

4. The paving machine as defined in claim 2 wherein said arcuate protrusions each comprise a plurality of members which are fixedly mounted with respect to each other.

5. The paving machine as defined in claim 1 wherein said rotor includes a cylindrical peripheral surface, and said drive means includes means mounting said rotor for eccentric rotation about said transverse axis and so that the rotor reciprocates in a substantially vertical direction during rotation thereof.

6. The paving machine as defined in claim 1 wherein said drive means acts to rotate said rotor in a direction corresponding to the intended forward direction of movement of the screed.

7. The paving machine as defined in claim 1, wherein said screed support assembly comprise a pair of tow arms on which said screed plate is mounted and a frame which is mounted on said tow arms and on which said strike off bar and said rotary compaction means are mounted.

8. The paving machine as defined in claim 1, further comprising means for changing the position of said asphalt screed with respect to said tractor.

9. The paving machine as defined in claim 8, wherein said means for changing comprises a manually actuated crank which is connected to said screed support assembly and which, when actuated, changes the angle of attack of said asphalt screed by changing the orientation of said screed support assembly.

10. An asphalt finishing screed adapted for use with a self propelled tractor having a pair of rearwardly extending tow arms pivoted at forward ends thereof to opposite sides of the tractor and with the finishing screed being attachable transversely between rear ends of the tow arms, said finishing screed comprising a strike off bar extending transversely across the width of the screed for spreading the mix delivered in front thereof to a predetermined thickness, rotary compaction means positioned behind said strike off bar and extending transversely across the width of the screed for compacting the mix which has been spread by said strike off bar, and comprising a rotor mounted for rotation about a transverse axis, said rotor including a plurality of transversely extending protrusions on the peripheral surface thereof and which are arcuately curved outwardly when viewed in a direction parallel to said transverse axis and which are circumferentially spaced apart, and drive means for rotating said rotor about said transverse axis, and a screed plate positioned behind said rotary compaction means and extending transversely across the width of the screed and having a horizontal bottom surface for engaging the compacted mix, wherein said arcuate protrusions each comprise a roller which is mounted for free rotation about an axis parallel to said transverse axis, and wherein said rotary compaction means further comprises a housing surrounding the upper portion of said rotor, and resilient means mounted to said housing for engaging said rollers during rotation of said rotor and imparting rotation to said rollers.

11. The finishing screed as defined in claim 10 further comprising means mounting said strike off bar so as to permit adjustment thereof in an a vertical direction.

12. The finishing screed as defined in claim 10 wherein said screed plate has a leading edge which is closely adjacent an outer circle generated by said rollers, and wherein said housing includes an end edge which is fixed to said screed plate.

13. The finishing screed as defined in claim 12 wherein said means mounting said strike off bar permits movement thereof along a direction which is about 45° from the vertical.

14. A roadway paving apparatus comprising a self propelled tractor comprising a hopper for receiving asphalt mix, conveyor means for conveying the asphalt mix from the hopper to a discharge location rearwardly of the tractor, auger means for transversely distributing the asphalt mix after being discharged at said discharge location, and a pair of rearwardly extending tow arms pivoted at their forward ends to respective opposite sides of said tractor so as to be freely floatable with respect to said tractor, and a finishing screed mounted transversely between the rearward ends of said tow arms so as to be free floating with said tow arms, said screed comprising (a) a vertically adjustable strike off bar extending transversely across the width of the screed for spreading the mix delivered from said discharge location to a predetermined thickness, (b) rotary compaction means positioned behind said strike off bar and extending transversely across the width of the screed for compacting the mix which has been spread by said strike off bar, and comprising a rotor mounted for rotation about a transverse axis, said rotor including a plurality of transversely extending protrusions on the peripheral surface thereof and which are arcuately curved outwardly when viewed in a direction parallel to said transverse axis and which are circumferentially spaced apart, and drive means for rotating said rotor about said transverse axis, and (c) a screed plate positioned behind said rotary compaction means and extending transversely across the width of the screed and having a horizontal bottom surface for engaging the compacted mix.

15. The roadway paving apparatus as defined in claim 14 wherein said arcuate protrusions each comprise a roller which is mounted for free rotation about an axis parallel to said transverse axis.

16. The paving machine as defined in claim 14, further comprising means for pivoting said tow arms with respect to said tractor.

17. The paving machine as defined in claim 16, wherein said means for changing comprises a manually actuated crank connected to at least one of said tow arms.

18. A method of compacting and smoothing an asphalt mix into a mat with a vehicle drawn assembly, comprising:

mounting a screed assembly on said vehicle so as to be freely floatable as a unit with respect to said vehicle, said screed assembly including a strike-off bar, a rotary compactor, and a screed plate, said rotary compactor being located behind said strike-off bar and said screed plate being located behind said rotary compactor, depositing the mix on the ground in front of said screed assembly, leveling the mix to a designated depth with said strike-off bar, then compacting the leveled mix with said rotary compactor, and then smoothing the compacted mix into said mat with said screed plate, and changing the depth of said mat by altering the position of said screed assembly with respect to said vehicle and by altering the height of said strike-off bar with respect to the remainder of said screed assembly, said screed assembly floating as a unit at a new height upon altering said position of said screed assembly and the height of said strike-off bar, thereby permitting said depth change.

19. The method as defined in claim 18, wherein said rotary compactor comprises a rotor which is rotatable about a transverse axis and which has a plurality of transversely extending protrusions which are arcuately curved outwardly when viewed in a direction parallel to said transverse axis and which are circumferentially spaced apart, and wherein said step of compacting comprises imposing a substantially vertical striking force on the leveled mix without said protrusions imposing a significant force component in either the forward or reverse direction.

* * * * *